US006888441B2

(12) United States Patent
Carey

(10) Patent No.: US 6,888,441 B2
(45) Date of Patent: May 3, 2005

(54) APPARATUS ADAPTED TO BE RELEASABLY CONNECTABLE TO THE SUB BASE OF A THERMOSTAT

(75) Inventor: Steven L. Carey, Imperial, MO (US)

(73) Assignee: Emerson Electric Co.

( * ) Notice: Subject to any disclaimer, the term of this patent is extended or adjusted under 35 U.S.C. 154(b) by 0 days.

(21) Appl. No.: 10/604,940

(22) Filed: Aug. 28, 2003

(65) Prior Publication Data

US 2004/0113748 A1 Jun. 17, 2004

(51) Int. Cl.[7] ..... H01H 37/04
(52) U.S. Cl. ..... 337/380; 337/381; 337/304
(58) Field of Search ..... 337/298, 300, 337/304, 333, 360, 363, 364, 370, 371, 380, 381

(56) References Cited

U.S. PATENT DOCUMENTS

| | | | | | |
|---|---|---|---|---|---|
| 2,137,569 | A | * | 11/1938 | Friedman | 200/51.02 |
| 3,007,028 | A | * | 10/1961 | Sorenson | 219/442 |
| 3,110,778 | A | * | 11/1963 | Edmunds | 200/50.17 |
| 3,197,594 | A | * | 7/1965 | Schmitt | 337/348 |
| 4,314,223 | A | * | 2/1982 | Kristofek | 337/113 |
| 4,421,271 | A | * | 12/1983 | Shavit | 236/82 |
| 4,485,282 | A | * | 11/1984 | Lee | 200/51 R |
| 4,704,595 | A | * | 11/1987 | Essig et al. | 337/107 |
| 4,902,999 | A | * | 2/1990 | Ball et al. | 337/372 |
| D310,177 | S | * | 8/1990 | Bensoussan et al. | D10/50 |
| 5,040,097 | A | * | 8/1991 | Stribel | 361/684 |
| 5,107,918 | A | * | 4/1992 | McFarlane et al. | 165/238 |
| 5,153,552 | A | * | 10/1992 | Krasser | 337/66 |
| 5,485,954 | A | * | 1/1996 | Guy et al. | 236/78 R |
| 6,169,937 | B1 | * | 1/2001 | Peterson | 700/276 |
| 6,252,492 | B1 | * | 6/2001 | Frank et al. | 337/365 |
| 6,315,580 | B1 | * | 11/2001 | Hurtubise et al. | 439/82 |
| 6,449,533 | B1 | | 9/2002 | Mueller et al. | 700/276 |
| 6,563,088 | B1 | * | 5/2003 | Wolf | 219/264 |

FOREIGN PATENT DOCUMENTS

| | | | | | |
|---|---|---|---|---|---|
| DE | 2241974 | A | * | 3/1974 | G05D/23/24 |
| GB | 2132826 | A | * | 7/1984 | H01R/13/70 |
| JP | 10328037 | A | * | 12/1998 | A47J/37/06 |

* cited by examiner

*Primary Examiner*—Anatoly Vortman
(74) *Attorney, Agent, or Firm*—Kevin Pumm

(57) ABSTRACT

An apparatus for controlling the operation of a HVAC system, where the apparatus is adapted to be releasably connectable to a thermostat sub-base assembly connected to an HVAC system. The apparatus is configured to be releasably connectable to the connector pins in a manner such that the apparatus may be slid onto the sub-base and easily removed without any disconnection of wiring. After completion of all construction, the apparatus may be removed and saved for future use, and a new digital thermostat may then be slid onto the connector pins of the sub-base.

13 Claims, 2 Drawing Sheets

APPARATUS ADAPTED TO BE RELEASABLY CONNECTABLE TO THE SUB BASE OF A THERMOSTAT

BACKGROUND OF INVENTION

In the construction of new residential and commercial buildings, it is advantageous to use the new building HVAC system during construction to maintain temperature for workers, as well as to dry out any joint compound and paint in the building. However, a new thermostat that is installed before construction is complete could be damaged or stained, and would subsequently need to be replaced. For this reason, new construction contractors often temporarily wire a thermostatic switch to the HVAC system for controlling the HVAC system during the construction phase. Once construction is finished, the temporary thermostatic switch is removed from the HVAC system wiring, and a new permanent thermostat is installed and wired to the HVAC system. The permanent thermostat is thereby maintained free of paint or scratches. Such prior art thermostatic switches for controlling an HVAC system required added contractor labor associated with removing HVAC wiring from the temporary thermostat and rewiring a new thermostat. Furthermore, the thermostatic switch may be exposed to paint and other construction materials, and does not provide the contractor with a HVAC Control apparatus that is durable enough to be reusable without frequent replacement. A need still exists for an inexpensive yet durable HVAC control apparatus that can be easily removed and replaced with a minimum of labor.

SUMMARY OF INVENTION

There is provided, in accordance with one aspect of the invention, an apparatus for controlling the operation of a HVAC system, where the apparatus is adapted to be connected to a plurality of connector pins on a thermostat sub-base assembly, which is connected to the wiring of the HVAC system. The thermostat sub-base is initially installed, and the HVAC wiring connected to terminals on the sub-base. The apparatus is configured to be releasably connectable to the connector pins of the thermostat sub-base in a manner such that the apparatus may be slid onto the sub-base and easily removed without requiring disconnection of any wiring. After completion of all construction, the apparatus may be removed and saved for future use, and a new digital thermostat may then be slid onto the connector pins of the sub-base. The apparatus further comprises at least one temperature actuated switching means for mechanically switching an HVAC circuit when the temperature within the building is below a predetermined temperature. When the temperature of the building space is below the predetermined temperature, the temperature actuated switching means switches power supplied from a first connector pin on the sub-base to a second connector pin on the sub-base so as to enable heating operation of the HVAC system to heat the space to the predetermined temperature. Unlike conventional thermostats, the predetermined temperature of the switching means is not adjustable by an occupant in the building. The apparatus may further comprise a second temperature actuated switching means for mechanically switching an HVAC circuit when the temperature within the building is above a second predetermined temperature. When the temperature of the building space exceeds the second predetermined temperature, the second temperature actuated switching means switches power supplied from a third connector pin on the sub-base to a fourth connector pin and a fifth connector pin on the sub-base so as to enable cooling operation of the HVAC system to cool the space to the second predetermined temperature. A housing enclosing the apparatus covers the temperature actuated switching means and the HVAC wiring connections to the thermostat sub-base to protect the apparatus and sub-base from damage from construction materials.

It is accordingly an object of the present invention to provide a simple, inexpensive apparatus for temporary connection to a thermostat sub-base for controlling an HVAC system to maintain a desired temperature within a space, wherein the apparatus is releasably connectable and removable from the thermostat sub-base without any rewiring or additional labor.

It is a further object of the present invention to provide an apparatus that is sufficiently durable to protect the HVAC wiring connections to a thermostat sub-base, and sufficiently durable to enable the apparatus to be reusable without the need for frequent replacement of the apparatus.

DETAILED DESCRIPTION

Figure 1:
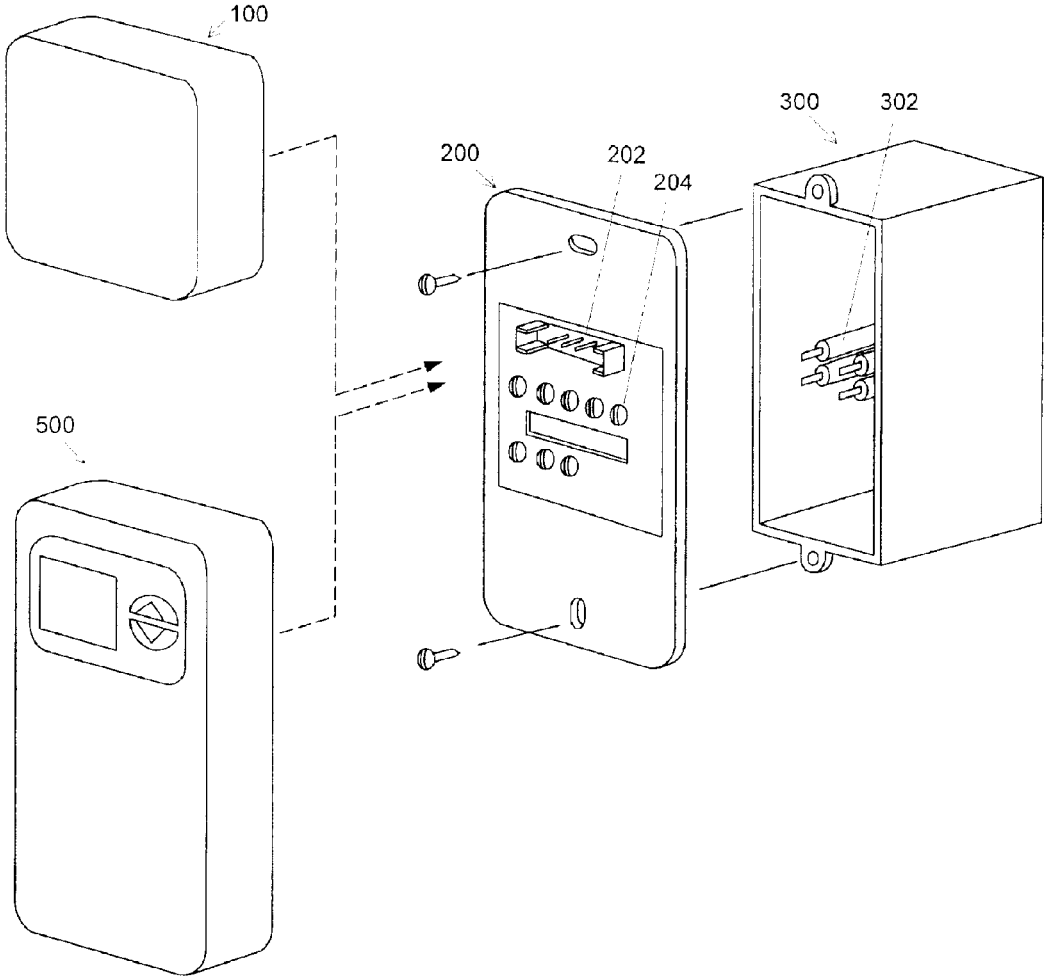
FIG. 1 is an assembly diagram showing the unassembled apparatus and sub-base of a preferred embodiment of the apparatus according to the principles of the present invention.

The apparatus according to the principles of the present invention is generally shown in FIG. 1, which shows an unassembled view of an electrical box 300 with HVAC wiring 302, a thermostat sub-base 200, a digital thermostat 500 for permanent assembly to the sub-base 200, and the apparatus 100 for temporary connection to the sub-base 200. A new construction contractor may often install an electrical box 300 for routing the building HVAC wiring 302 through. The contractor can install the thermostat sub-base 200 depicted in FIG. 1 to the electrical box 300, and connect the HVAC wiring 302 to the sub-base 200, without having to subsequently remove the sub-base 200 or HVAC wiring 302. The HVAC wiring 302 may be connected to a plurality of terminals 204 on the thermostat sub-base 200, which further comprises a plurality of connector pins 202 associated with the plurality of terminals 204. The apparatus 100 is adapted to be releasably connectable to the plurality of connector pins 202 on the thermostat sub-base assembly 200 in a manner such that the apparatus may be slid onto the sub-base and easily removed from the sub-base 200, after which a permanent digital thermostat 500 may then be connected to. Typically, a thermostat requires connection of a minimum of HVAC wires corresponding to the letter designations C, RH, RC, W, G, Y, O and B. Letter designation RH typically corresponds to a transformer power source for a heating system, and letter designation W corresponds to activation of the heating system of an HVAC system. Letter designation RC typically corresponds to a transformer power source for a cooling system, and letter designations G and Y correspond to activation of a blower fan and air conditioner compressor of an HVAC system.

Figure 2:
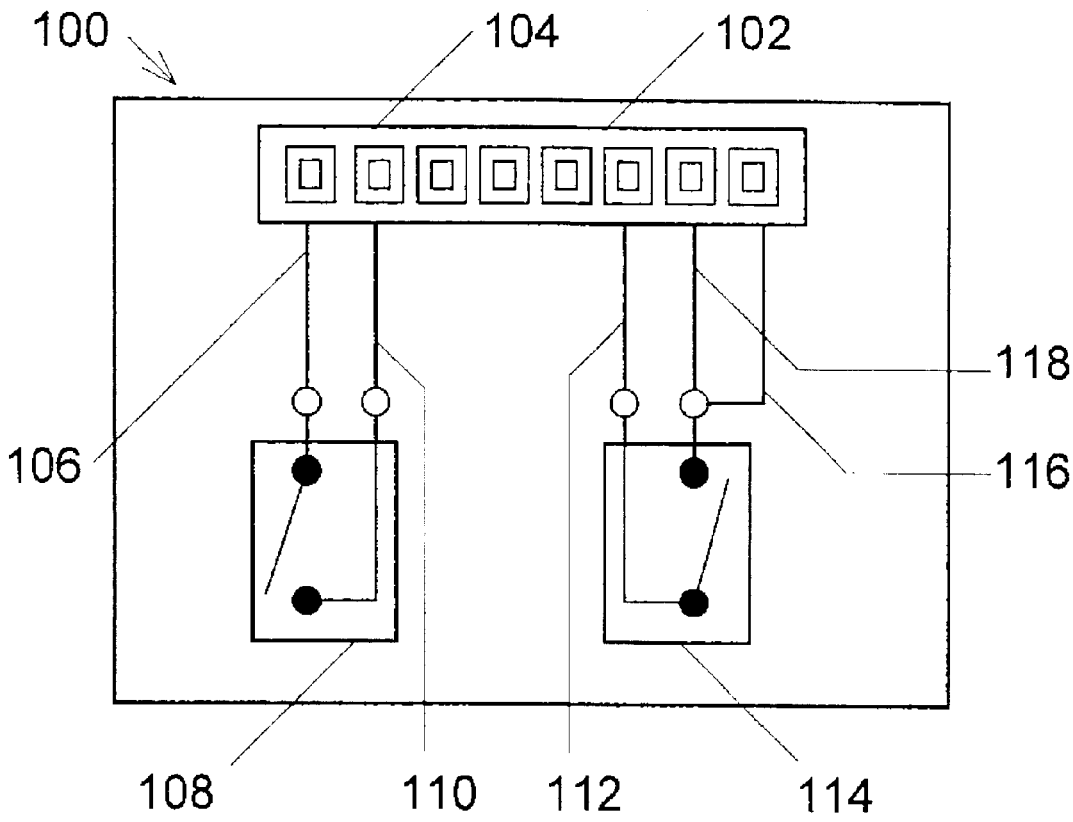
FIG. 2 is a schematic of an alternate embodiment of the apparatus showing a first and second temperature actuated switching means according to the principles of the present invention.

Referring to FIG. 2, the apparatus 100 comprises a circuit board 102, and a connector 104 configured to be releasably connectable to the plurality of connector pins 202 of the thermostat sub-base 200. The apparatus further comprises at least a first one temperature actuated switching means 108 for mechanically switching an HVAC circuit closed when the temperature within the building is below a predetermined temperature. A first connector pin on the sub-base 200 is associated with the HVAC connection designated RH, and a second connector pin is associated with the HVAC connection designated W, wherein the first and second connector pins are associated with activation of the heating system of an HVAC system. When the temperature of the building space is below a predetermined temperature, the temperature actuated switching means 108 switches power supplied from the first connector pin through connector 104 and lead 106 to lead 110 to a second connector pin so as to enable operation of a heating system to heat the space to the predetermined temperature. When exposing the temperature activated switching means 108 to a predetermined temperature, a thermally actuated member mechanically switches to a closed position to complete a connection through the switching means 108. The temperature actuated switching means 108 is preferably a SC065 switch manufactured by Instruments Controls and Measurement, Inc., which is designed to close at or below 65 degrees Fahrenheit and open above 65 degrees, but the switch may also be a similarly constructed device. Unlike conventional thermostats, the predetermined temperature of the switching means is not adjustable by an occupant in the building but is fixed by the manufacturer of the device. The apparatus also does not require batteries or a power source to control the HVAC system. Thus, the apparatus 100 provides simple control of the HVAC system to continuously maintain a minimum temperature within the building.

In another embodiment, the apparatus may further comprise a second temperature actuated switching means 114 for mechanically switching an HVAC circuit when the temperature within the building is above a second predetermined temperature. A third connector pin on the sub-base 200 is associated with the HVAC connection designated RC, a fourth connector pin is associated with the HVAC connection designated G, and a fifth connector pin on the sub-base 200 is associated with the HVAC connection designated Y, wherein the third, fourth and fifth connector pins are associated with activation of the air conditioner blower and compressor of an HVAC system. When the temperature of the building space exceeds the second predetermined temperature, the temperature actuated switching means 114 switches power supplied from a third connector pin through connector 104 and lead 112 to leads 116 and 118 and to a fourth connector pin and fifth connector pin on the sub-base 200 so as to enable cooling operation of the HVAC system to cool the space to the second predetermined temperature. The temperature actuated switching means 114 is preferably a 36T01 snap action switch manufactured by Therm-O-Disc, Inc., which is designed to close the switch at or above 75 degrees Fahrenheit and to open the switch below 75 degrees Fahrenheit. The temperature actuated switching means 114 may also be a SC075 switch manufactured by Instruments Controls and Measurement. Inc., which is designed to close at or above 75 degrees Fahrenheit and to open below 75 degrees Fahrenheit, but may also be a similarly constructed device.

The apparatus 100 shown in FIG. 1 further comprises a housing for covering the temperature actuated switching means 108 and 114, and the HVAC wire connections 302 to the thermostat sub-base 200. This protects the apparatus 100 and sub-base 200 from damage during construction. After completion of all construction, the apparatus 100 may be removed and saved for future use at other construction sites, and a new digital programmable thermostat 500 may then be slid onto the connector pins 202 of the sub-base 200. The sub-base 200 that the apparatus 100 is configured to connect to is preferably the sub-base of a digital programmable thermostat having a part number 1F78H/C, manufactured by White-Rodgers Division of Emerson Electric Co. The sub-base 200 of the above referenced thermostat comprises an eight-pin connector that is in connection with eight terminals on the sub-base for connecting HVAC wiring to. The terminals correspond to HVAC wiring of letter designation RH for a heating transformer connection, RC for a cooling transformer connection, C for a transformer common connection, W for activation of the heating relay, Y for activation of the air conditioning compressor, G for activation of the blower fan, and O and B for heat pump reverse valve control. The apparatus does not obtain power or steal power from any HVAC connection, or from a battery source, to control the HVAC system, but rather controls the HVAC system through mechanical switching means. The apparatus 100 comprises a socket connector that is uniquely configured to releasably connect to the eight connector pins of the above referenced sub-base 200 in such a manner as to mate the RH and W connections of the HVAC system with a temperature actuated switching means, and the RC, G and Y connections of the HVAC system with a second optional temperature actuated switching means for controlling the HVAC system. The temperature actuated switching means mechanically switch the RH and W connections and the RC and Y connections to control activation of the heating and air conditioning systems respectively. The apparatus 100 of the present invention accordingly provides for temporary connection to a thermostat sub-base for controlling an HVAC system to maintain a desired temperature within a space, wherein the apparatus is releasably connectable from the thermostat sub-base and reusable for future new building construction While the connector 104 of the apparatus 100 is configured to connect to the eight connector pins on the sub-base 200 referenced above, it should not be so limited as to exclude connection to a sub-base having only five connector pins, or any other modifications within the spirit of the invention.

Those skilled in the art will recognize that the inventive apparatus that is adapted to be releasably connectable to a thermostat sub-base for controlling an HVAC system may be useful in temporarily controlling many air conditioning and heating applications, and is especially useful for control of a newly installed HVAC system. In as much as many modifications within the spirit of the invention will be apparent to those skilled in the art, the scope of the invention should be determined by reference to the claims appended below and the full scope of equivalents as provided by applicable laws.

What is claimed is:

1. An apparatus adapted to be connected to a thermostat sub-base assembly in connection with an HVAC system, the apparatus comprising:

a connector configured to be releasably connectable to the sub-base assembly; and a temperature-actuated switching means for actuating, independent of any electrical power application, to switch power supplied from a first connection on the sub-base to a second connection on the sub-base so as to enable heating operation of the HVAC system when the temperature-actuated switching means is exposed to an ambient temperature below a non-adjustable predetermined temperature.

2. The apparatus of claim 1, further comprising a housing that covers the connector and connection to the sub-base assembly so as to prevent damage or entry of unwanted materials.

3. The apparatus of claim 2, further comprising a second temperature actuated switching means that actuates, independent of any electrical power application, when exposed to an ambient temperature above a second non-adjustable predetermined temperature, where the second temperature actuated switching means switches power supplied from a third connection on the sub-base to a fourth connection and fifth connection on the sub-base so as to enable cooling operation of the HVAC system when the second switching means is exposed to an ambient temperature above a second predetermined temperature.

4. An apparatus adapted to be connected to a thermostat sub-base assembly having a plurality of connector pins in connection with an HVAC system, the apparatus comprising:

a connector configured to be releasably connectable to the connector pins on the sub-base assembly; and a temperature-actuated switching means for actuating, independent of any electrical power application, to switch power supplied from a first connector pin on the sub-base to a second connector pin on the sub-base so as to enable heating operation of the HVAC system when the temperature actuated switching means is exposed to an ambient temperature below a non-adjustable predetermined temperature.

5. The apparatus of claim 4, further comprising a housing that covers the connector and connector pins of the sub-base assembly so as to prevent damage or entry of unwanted materials.

6. The apparatus of claim 5, further comprising a second temperature actuated switching means that actuates, independent of any electrical power application, when exposed to an ambient temperature above a second non-adjustable predetermined temperature, where the second temperature actuated switching means switches power supplied from a third connector pin on the sub-base to a fourth connector pin and fifth connector pin on the sub-base so as to enable cooling operation of the HVAC system when the second switching means is exposed to an ambient temperature above a second non-adjustable predetermined temperature.

7. An apparatus adapted to be connected to a thermostat sub-base assembly having a plurality of connector pins associated with a plurality of terminals for connecting to an HVAC system, the apparatus comprising:

a connector configured to be releasably connectable to the connector pins on the sub-base assembly; and a temperature-actuated switching means for actuating, independent of any electrical power application, to switch power supplied from a first connector pin on the sub-base to a second connector pin on the sub-base so as to enable heating operation of the HVAC system when the temperature actuated switching means is exposed to an ambient temperature below a non-adjustable predetermined temperature.

8. The apparatus of claim 7, further comprising a housing that covers the connector and connector pins of the sub-base assembly so as to prevent damage or entry of unwanted materials.

9. The apparatus of claim 8, further comprising a second temperature actuated switching means that actuates, independent of any electrical power application, when exposed to an ambient temperature above a second non-adjustable predetermined temperature, where the second temperature actuated switching means switches power supplied from a third connector pin on the sub-base to a fourth connector pin and fifth connector pin on the sub-base so as to enable cooling operation of the HVAC system when the second switching means is exposed to an ambient temperature above a second non-adjustable predetermined temperature.

10. An apparatus in combination with a thermostat sub-base assembly having a plurality of connector pins associated with a plurality of terminals for connecting to an HVAC system, the apparatus comprising:

a connector configured to be releasably connectable to the connector pins on the sub-base assembly;

a temperature-actuated switching means for actuating, independent of any electrical power application, to switch power supplied from a first connector pin on the sub-base to a second connector pin on the sub-base so as to enable heating operation of the HVAC system when the temperature actuated switching means is exposed to an ambient temperature below a non-adjustable predetermined temperature; and a housing that covers the connector and connection pins of the sub-base assembly so as to prevent damage or entry of unwanted materials.

11. The apparatus of claim 10, further comprising a second temperature actuated switching means that actuates, independent of any electrical power application, when exposed to an ambient temperature above a second non-adjustable predetermined temperature, where the second temperature actuated switching means switches power supplied from a third connector pin on the sub-base to a fourth connector pin and fifth connector pin on the sub-base so as to enable cooling operation of the HVAC system when the second switching means is exposed to an ambient temperature above a second non-adjustable predetermined temperature.

12. The apparatus of claim 10, wherein the first and second temperature actuated switching means provide thermally actuated switching of power to an HVAC system independent of and without requiring power from a battery or external power source.

13. The apparatus of claim 10, wherein the sub-base comprises eight connector pins and the connector is a socket connector configured to be releasably connectable to the eight connector pins.

* * * * *